United States Patent [19]

Suto et al.

[11] Patent Number: 4,892,722

[45] Date of Patent: Jan. 9, 1990

[54] METHOD FOR PRODUCING HIGH STRENGTH, HIGH MODULUS MESOPHASE-PITCH-BASED CARBON FIBERS

[75] Inventors: Yoshinori Suto; Toshiyuki Ito; Hideyuki Nakajima; Yoshiyuki Suzuki; Shin-ichi Nayuki, all of Ibarakiken; Hiroyasu Ogawa; Harumitsu Enomoto, both of Shizuokaken, all of Japan

[73] Assignee: Petoca Ltd., Tokyo, Japan

[21] Appl. No.: 201,990

[22] Filed: Jun. 3, 1988

[30] Foreign Application Priority Data

Jun. 5, 1987 [JP] Japan ..... 62-139980

[51] Int. Cl.[4] ..... C01B 31/04

[52] U.S. Cl. ..... 423/448; 423/442.1; 423/447.2; 423/447.4; 423/447.6; 423/449; 264/29.2

[58] Field of Search ..... 423/447.1, 447.2, 447.4, 423/447.6, 448, 449; 264/29.2

[56] References Cited

U.S. PATENT DOCUMENTS

| | | | |
|---|---|---|---|
| 3,634,035 | 11/1972 | Stuetz et al. | 423/448 |
| 3,702,054 | 11/1972 | Araki et al. | 423/447.1 |
| 3,764,662 | 10/1973 | Roberts | 423/448 |
| 3,976,746 | 8/1976 | Wizon | 264/29.2 |
| 4,100,004 | 7/1978 | Moss et al. | 264/29.2 |
| 4,131,644 | 12/1978 | Nagasaka et al. | 264/29.2 |
| 4,209,500 | 6/1980 | Chwastiak | 264/29.2 |
| 4,574,077 | 3/1986 | Uemura et al. | 264/29.2 |
| 4,609,540 | 9/1986 | Ozumi et al. | 423/447.2 |
| 4,610,860 | 9/1986 | Mullen | 423/447.4 |
| 4,705,618 | 11/1987 | Tsuchitani et al. | 423/447.1 |

FOREIGN PATENT DOCUMENTS

| | | | |
|---|---|---|---|
| 10254 | 9/1972 | Japan . | |
| 114123 | 5/1983 | Japan . | |
| 169515 | 8/1983 | Japan . | |
| 168123 | 2/1984 | Japan . | |
| 114624 | 11/1984 | Japan . | |
| 69826 | 9/1987 | Japan . | |
| 8501752 | 4/1985 | World Int. Prop. O. | 264/29.2 |

*Primary Examiner*—John Doll
*Assistant Examiner*—Robert M. Kunemund
*Attorney, Agent, or Firm*—Armstrong, Nikaido, Marmelstein, Kubovcik & Murray

[57] ABSTRACT

A method for producing high strength, high modulus carbon fibers having a modulus of elasticity of 75 tonf/mm$^2$ or more and a tensile strength of 250 kgf/mm$^2$ or more is provided. This method comprises graphitizing mesophase-pitch-based carbon fibers at a temperature of 2600° C. or more for several seconds or for several minutes while stretching said fibers with a stretching ratio which satisifies specified relations.

1 Claim, 3 Drawing Sheets

METHOD FOR PRODUCING HIGH STRENGTH, HIGH MODULUS MESOPHASE-PITCH-BASED CARBON FIBERS

BACKGROUND OF THE INVENTION

1. Field of Art

This invention relates to a method for producing high strength, high modulus mesophase-pitch-based carbon fibers. More particularly, it relates to a method of graphitization of mesophase-pitch-based carbon fibers for producing high strength, high modulus carbon fibers having excellent qualities, especially high grade of mechanical property, at relatively inexpensive cost by a stabilized operation. This invention is directed to a preferable method relating to high strength, high modulus carbon fibers having a modulus of elasticity of 75 tonf/mm$^2$ or more and a tensile strength of 250 kgf/mm$^2$ or more.

2. Prior Art

It is well known that petroleum pitch based carbon fibers have been heretofore produced from residual carbonaceous materials obtained as by-product of thermal catalytic cracking (FCC) of vacuum gas oil or thermal cracking of naphtha.

Carbon fibers have been used in broad application fields such as aeronautic and space construction materials and articles for the use of sports, etc., because of their various superior properties such as mechanical, chemical and electric properties, together with their advantage of light weight.

Particularly, mesophase-pitch-based carbon fibers as different from the carbon fibers produced from organic polymer-based fibers such as PAN, provide easily high modulus of elasticity by carbonization-graphitization treatment, hence demand for the production of high modulus carbon fibers having a modulus of elasticity of 75 tonf/mm$_2$ or more is increasing. However, even in case of mesophase-pitch-based carbon fibers, a high temperature graphitization treatment is necessary in order to obtain a high modulus of elasticity. As an apparatus for obtaining high temperature, a graphitization furnace, in which a furnace element is made of a carbon material, is commonly used. For producing carbon fibers having a modulus of elasticity of 75 tonf/mm$^2$ or more, a treatment temperature approaches to the sublimation temperature of carbon of 3000° C. and there is a problem in the point that life of a furnace element is extremely short and the cost of carbon fibers becomes very expensive. Since mesophase-pitch-based carbon fibers are of high modulus of elasticity, they are brittle materials having an elongation of 0.5% or lower. Thus it is also another problem that if a forcible stretching is applied during the graphitization, bad effects occur to processability and quality of products such as forming of fluffs, etc.

Different from organic-polymer-based carbon fibers such as PAN or the like, since mesophase-pitch-based carbon fibers can provide easily relatively high modulus of elasticity, they are not usually stretched positively in the carbonization and graphitization treatment.

It is an object of the present invention to provide a process for producing carbon fibers in which the problem of occurrence of a large number of fluffs by a forcible stretching and the other problem of increasing production cost by extremely shortening the life of a furnace element of a graphitization furnace in the attempt for obtaining excessively high temperature, have been overcome, based upon the finding that an application of stretching is very effective for increasing modulus of elasticity of mesophase-pitch-based carbon fibers at the time of the graphitization at a temperature of 2600° C. or more for the production of high strength, high modulus carbon fibers having a modulus of elasticity of 75 tonf/mm$^2$ or more and a tensile strength of 250 kgf/mm$^2$ or more.

SUMMARY OF THE INVENTION

The present invention resides in a method for producing high strength, high modulus carbon fibers having a modulus of elasticity of 75 tonf/mm$^2$ or more and a tensile strength of 250 kgf/mm$^2$ or more which comprises graphitizing mesophase-pitch-based carbon fibers at a temperature of 2600° C. or more for several seconds or for several minutes while stretching said fibers with a stretching ratio S and a modulus of elasticity M which satisfy the relation of equation (1) in case of a modulus of elasticity of 2 tonf/mm$^2$ or more and 10 tonf/mm$^2$ or less and the relation of equation (2) in case of a modulus of elasticity of 10 tonf/mm$^2$ or more and 70 tonf/mm$^2$ or less.

$$0.557M+0.79 \leqq S \leqq 0.371M+5.06 \quad (1)$$

$$-0.102M+7.38 \leqq S \leqq -0.121M+9.98 \quad (2)$$

wherein M is a modulus of elasticity (tonf/mm$^2$) and S is a stretching ratio (%).

According to the method of the present invention, it is possible to produce high strength, high modulus mesophase-pitch-based carbon fibers through a stabilized process efficiently and at relatively inexpensive cost.

DESCRIPTION OF THE PREFERRED EMBODIMENT

Figure 1:
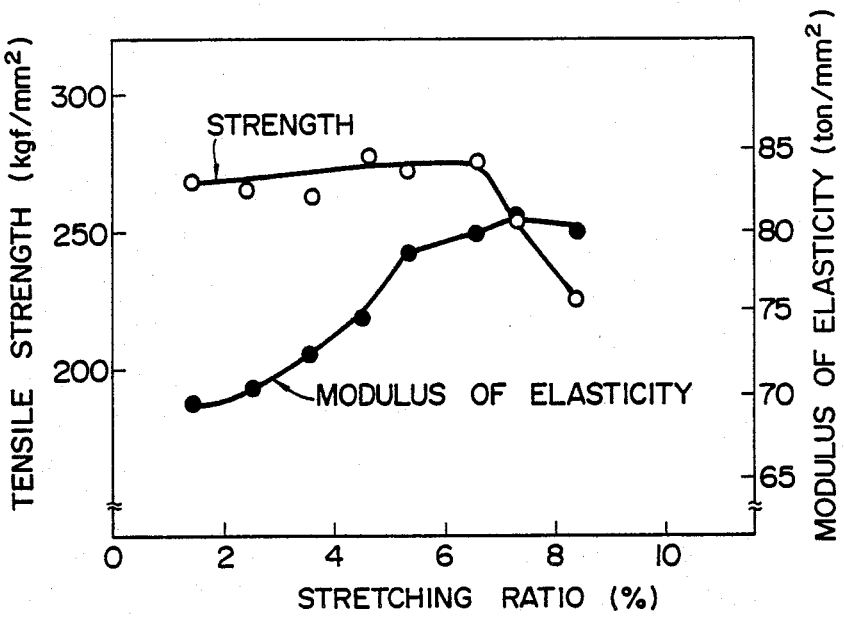
FIGS. 1–5 indicate relationship between stretching ratio at the time of graphitization treatment and tensile strength and modules of elasticity of resulting fibers.

Raw materials for the mesophase pitch in the present invention include residual oil of atmospheric distillation of petroleum oil, residual oil of vacuum distillation of petroleum oil, residual oil of thermal catalytic cracking of gas oil, petroleum based heavy oils such as a pitch which is by-product of the heat treatment of these residual oils, and coal based heavy oils such as coal tar and coal-liquidized product. Pitch containing 100% mesophase can be produced by the heat treatment of the above-mentioned raw materials in the non-oxidative atmosphere to produce mesophase allowing the mesophase to grow, and separating the mesophase pitch by the difference of specific gravity through sedimentation. It is preferable to use the mesophase pitch produced according to the above-mentioned sedimentation separation process than a pitch produced by a common process in the production process of carbon fibers according to the present invention. After the above-mentioned mesophase pitch is subjected to melt-spinning through a nozzle, preferably having an enlarged part at the outlet hole of nozzle, spun fibers are subjected to infusiblization and carbonization-graphitization treatment. It has been known that modulus of elasticity of carbon fibers having been subjected to infusiblization treatment and carbonization-graphitization treatment varies according to a treating temperature. Carbon fibers used as raw materials in the present invention are those having a modulus of elasticity of 2 tonf/mm$^2$ or more and 70 tonf/mm$^2$ or less.

According to the method of the present invention, above-mentioned fibers are subjected to graphitization treatment, i.e. heat treatment in an inert atmosphere at a temperature higher than 2600° C. preferably in the range of 2700°–2900° C. while stretching with stretching ratio S which satisfies the condition of equation (1) when a modulus of elasticity is 2 tonf/mm$^2$ or more and 10 tonf/mm$^2$ or less and the condition of equation (2) when a modulus of elasticity is 10 tonf/mm$^2$ or more and 70 tonf/mm$^2$ or less.

If the graphitization temperature is less than 2600° C. carbon fibers of the object of the present invention, having a modulus of elasticity of 75 tonf/mm$^2$ or more and tensile strength of 250 kgf/mm$^2$ or more cannot be produced efficiently.

Further, if a treatment temperature of graphitization is more than 2900° C., the life of a furnace element is shortened and continuation of stable production for a long period of time becomes difficult. The graphitization of the present invention means a heat treatment, carried out preferably at a temperature in the range of 2600°–2900° C., while stretching fibers with a stretching ratio S which satisfies the above-mentioned equation (1) or (2). The maintenance of this treatment condition is indispensable not only for obtaining high strength and high modulus but also for stabilization of process. Stretching ratio is calculated from the following equation.

$$\text{stretching ratio} = \frac{(\text{velocity of delivery roller at the outlet}) - (\text{velocity of delivery roller at the inlet})}{(\text{velocity of delivery roller at the inlet})} \times 100$$

The present invention will be described more following non-limitative examples. Percentage "%" other than stretching ratio is by weight unless otherwise indicated.

EXAMPLE 1

A distillate fraction of residual oil of thermal catalytic cracking (FCC) having an initial distillate of 450° C. and a final distillate of 560° C. was subjected to heat treatment at a temperature of 400° C. for 6 hours while introducing therein methane gas and further heated at a temperature of 330° C. for 8 hours to grow mesophase and the mesophase pitch was separated by sedimentation utilizing the difference of specific gravity from non-mesophase pitch. This mesophase pitch contains 100% optically anisotropic component, 63% pyridine insoluble portion and 87% toluene insoluble portion. After this pitch was subjected to melt spinning at a velocity of 270 m/min. by using a spinning nozzle having 1000 nozzle holes whose outlet parts were enlarged, resulting fibers were subjected to infusiblization on a net conveyor at a heating rate of 2° C./min. from 180° C. to 320° C.

Resulting infusiblized fibers were subjected to carbonization treatment at a temperature of 1800° C. in the atmosphere of argon to obtain carbon fibers having a tensile strength of 223 kgf/mm$^2$ and a modulus of elasticity of 23 tonf/mm$^2$. Further resulting carbon fibers were subjected to graphitization treatment at a temperature of 2800° C. for 30 seconds while employing stretching ratio indicated in Table 1 and obtained graphitized fibers had properties indicated in Table 1.

TABLE 1

| properties of graphitized fibers at 2800° C. | | |
|---|---|---|
| stretching ratio (%) | tensile strength (kgf/mm$^2$) | modulus of elasticity (tonf/mm$^2$) |
| 1.3 | 271 | 68 |
| 2.2 | 270 | 69 |
| 3.6 | 268 | 72 |
| 4.5 | 278 | 74 |
| 5.1 | 274 | 78 |
| 6.2 | 276 | 79 |
| 7.0 | 252 | 81 |
| 8.2 | 230 | 80 |
| 9.5 | production was impossible because of too much amount of fluffs | |

From Table 1, FIG. 1 was prepared. It was found that in order to obtain fibers having physical properties 250 kgf/mm$^2$ or more in tensile strength and 75 tonf/m$^2$ or more in modulus of elasticity, it was preferable to carry out graphitization treatment with a stretching ratio of from 5% to 7.2%

EXAMPLE 2

Infusiblized fibers prepared similarly as in example 1 were subjected to carbonization treatment at a temperature in the range of 700° C. to 2700° C. and carbon fibers having different modulus of elasticity as shown in Table 2 were obtained.

TABLE 2

Figure 2:
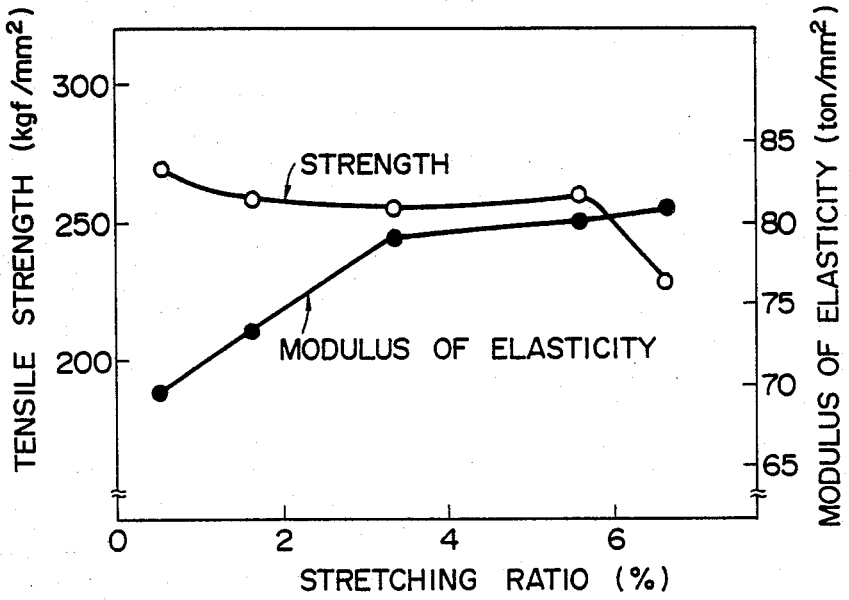
Figure 3:
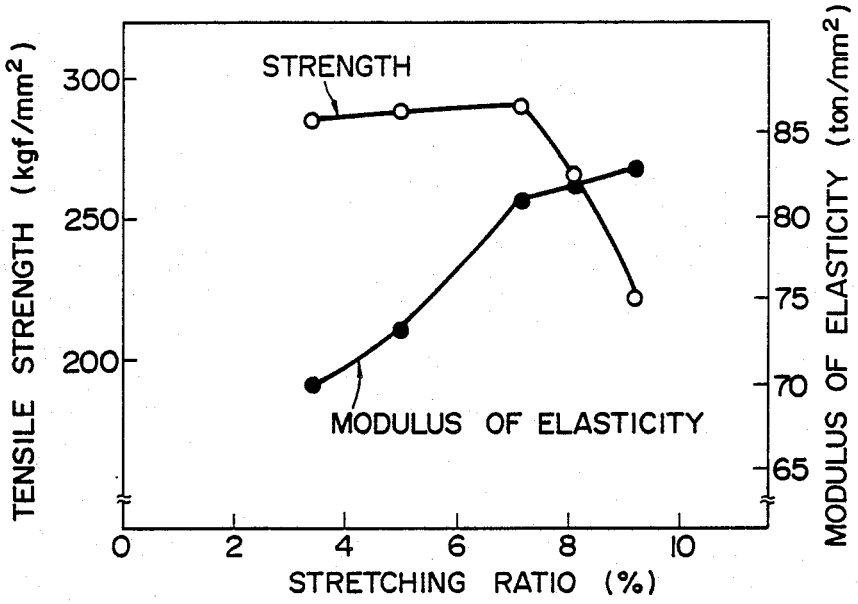
Figure 4:
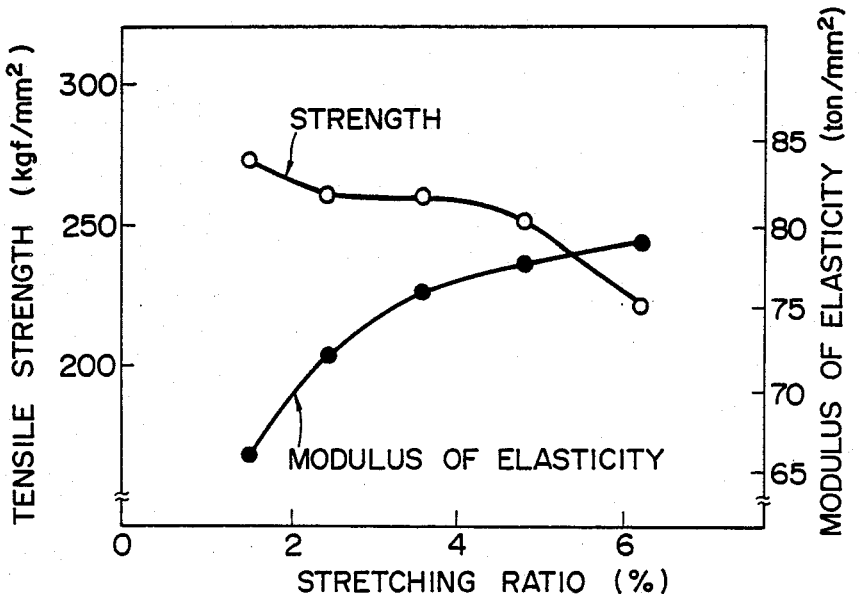
Figure 5:
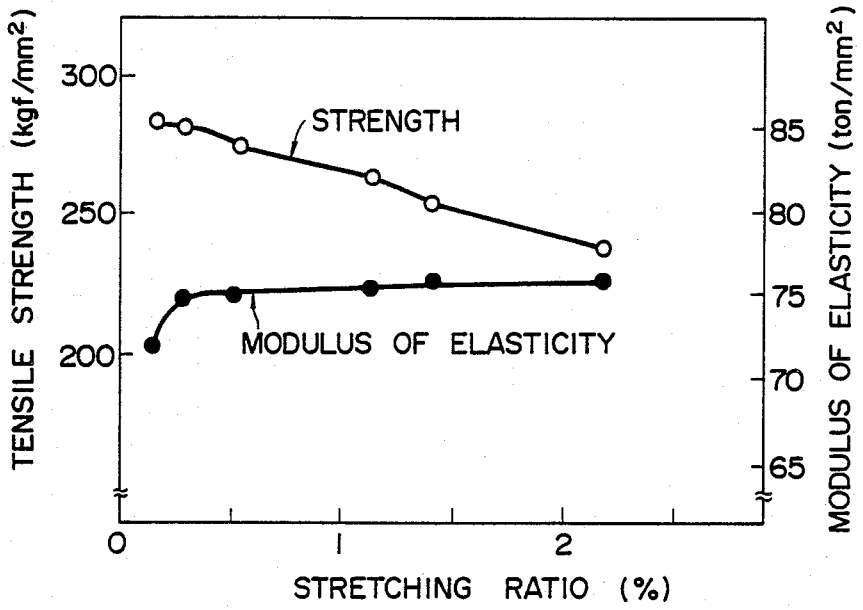

| No. | treatment temperature(°C.) | tensile strength (kgf/mm$^2$) | modulus of elasticity (tonf/mm$^2$) | Example |
|---|---|---|---|---|
| 1 | 700 | 30 | 3 | FIG. 2 |
| 2 | 1000 | 114 | 9 | FIG. 3 |
| 3 | 2200 | 279 | 42 | FIG. 4 |
| 4 | 2700 | 285 | 70 | FIG. 5 |

Figure 6:
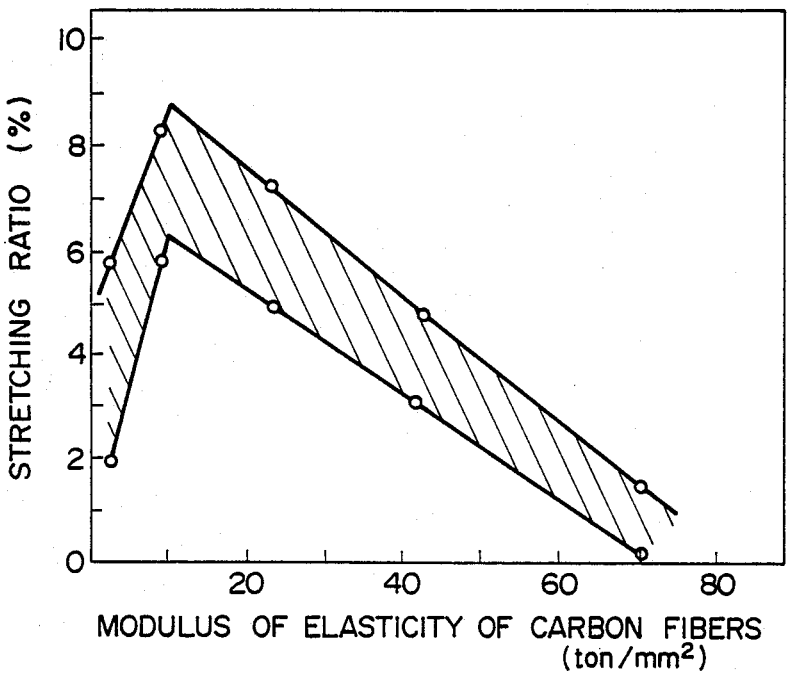
FIG. 6 indicates the range of the equations (1) and (2) which define the relation of modules of elasticity and stretching ratio of carbon fibers.

Further, graphitized fibers having properties indicated in FIG. 2 to FIG. 5 were obtained by the graphitization treatment carried out at a temperature of 2800° C. for 30 second while stretching. FIG. 6 which shows most preferable range of stretching ratio was prepared from the results of FIG. 1 to FIG. 5.

From FIG. 6 it has been concluded to be preferable that when a modulus of elasticity of carbon fibers is 2 tonf/mm$^2$ or more and 10 tonf/mm$^2$ or less, graphitization is to be carried out with a stretching ratio S which satisfies the condition of equation (1) and when a modulus of elasticity of carbon fibers is 10 tonf/mm$^2$ or more, or 70 tonf/mm$^2$ or less, graphitization is to be carried out so as to give a stretching ratio S which satisfies the condition of equation (2). In case of stretching ratio lower than the equations (1) and (2), it was not possible to give a tensile strength greater than 250 kgf/mm$^2$ and a modulus of elasticity greater than 75 tonf/mm$^2$. In case of higher stretching ratio than the equation (1) and (2), production was impossible due to fluff forming, etc., or produced fibers were not fit for practical use.

Effectiveness of the Invention

According to the method of the present invention, remarkable shortening of life of a furnace element did not occur and the graphitized fibers were produced through relatively stabilized process and at relatively inexpensive cost.

What is claimed is:

1. A method for producing high strength, high modulus mesophase-pitch-based carbon fibers having a modulus of elasticity of 75 tonf/mm$^2$ or more and a tensile strength of 250 kgf/mm$^2$ or more which comprises heat treating mesophase-pitch-based carbon fibers at a temperature of 2600° C. to 2900° C. while stretching said fibers with a stretching ratio S which satisfies the relation of equation (1) in the case of a modulus of elasticity of 2 tonf/mm$^2$ or more and 10 tonf/mm$^2$ or less and the relationship of equation (2) in the case of a modulus of elasticity of 10 tonf/mm$^2$ or more and 70 tonf/mm$^2$ or less.

$$0.337M+0.79 \leqq S \leqq 0.371M+5.06 \quad (1)$$

$$-0.102M+7.38 \leqq S \leqq -0.121M+9.98 \quad (2)$$

wherein M is a modulus of elasticity (tonf/mm$^2$) and S is stretching ratio (%)

* * * * *